US009814104B2

(12) United States Patent
Hunter

(10) Patent No.: US 9,814,104 B2
(45) Date of Patent: Nov. 7, 2017

(54) SPACE-EFFICIENT CHOKE SYSTEM FOR CONTAINING RF LEAKAGE

(71) Applicant: Illinois Tool Works Inc., Glenview, IL (US)

(72) Inventor: Richard E. Hunter, Liberty Township, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 224 days.

(21) Appl. No.: 14/606,223

(22) Filed: Jan. 27, 2015

(65) Prior Publication Data

US 2016/0219656 A1 Jul. 28, 2016

(51) Int. Cl.
*H05B 6/76* (2006.01)
*H05B 6/64* (2006.01)

(52) U.S. Cl.
CPC ..... *H05B 6/763* (2013.01); *H05B 6/6414* (2013.01)

(58) Field of Classification Search
CPC ..... H05B 6/6414; H05B 6/763
USPC ..... 219/738, 739, 740, 741, 742, 743, 744, 219/678, 754, 756, 757; 174/35 R, 174/35 GC; 126/190, 198, 214
See application file for complete search history.

(56) References Cited

U.S. PATENT DOCUMENTS

| | | | | |
|---|---|---|---|---|
| 7,002,124 B2 * | 2/2006 | Kim | ..... | H05B 6/763 219/678 |
| 2003/0141298 A1 * | 7/2003 | Lee | ..... | H05B 6/763 219/741 |
| 2005/0072777 A1 * | 4/2005 | Kim | ..... | H05B 6/763 219/741 |

FOREIGN PATENT DOCUMENTS

| | | | |
|---|---|---|---|
| EP | 1333703 | A2 | 8/2003 |
| EP | 1401244 | A2 | 3/2004 |
| EP | 1521502 | A1 | 4/2005 |
| KR | 100910784 | B1 * | 8/2009 |

OTHER PUBLICATIONS

International Search Report and Written Opinion of corresponding application No. PCT/US2015/062654, dated Mar. 1, 2016, all enclosed pages cited.

* cited by examiner

*Primary Examiner* — Quang Van
(74) *Attorney, Agent, or Firm* — McNair Law Firm, P.A.

(57) ABSTRACT

A choke assembly for provision onto an oven door to seal radio frequency (RF) energy within the oven when the door is closed may include a capacitive coupling element and an inductive tuning element. The capacitive coupling element may include a plurality of tabs each having a first width. The inductive tuning element may include a plurality of projections bent relative to the capacitive coupling elements at a right angle, the projections each having a second width that is smaller than the first width.

16 Claims, 7 Drawing Sheets

SPACE-EFFICIENT CHOKE SYSTEM FOR CONTAINING RF LEAKAGE

TECHNICAL FIELD

Example embodiments generally relate to ovens and, more particularly, relate to provision of a space-efficient choke for an oven that is enabled to cook using radio frequency (RF).

BACKGROUND

Combination ovens that are capable of cooking using more than one heating source (e.g., convection, steam, microwave/RF, etc.) have been in use for decades. Each cooking source comes with its own distinct set of characteristics. Thus, a combination oven can typically leverage the advantages of each different cooking source to attempt to provide a cooking process that is improved in terms of time and/or quality.

Whether employed in the context of a combination oven, or a microwave/RF oven, any oven that employs RF cooking will likely need to provide a way to ensure that the RF is contained within the oven. Shielding of the majority of the oven cavity and the door does not typically present technical challenges, and leakage through these boundaries is often easily held relatively low. However, the interface between the walls of the oven cavity and the door can be one of the more challenging areas at which leakage prevention mechanisms must be developed. In many countries specific standards are defined to identify the maximum amount of RF leakage that is allowable from the oven.

One mechanism for ensuring that RF leakage is held below applicable standards at this interface is to employ a choke at the interface. The choke is provided to seal RF energy at the interface by providing what is essentially a tuned reflector assembly to keep RF energy in the oven cavity. These chokes are typically constructed based on providing a quarter-wave resonant circuit. More particularly, such chokes often employ uniform width ¼ wavelength (λ) resonant elements. However, given that the architecture of these typical chokes is dependent on uniform ¼ wavelength width dimensions, the width of the choke can become too large for some target frequencies. Accordingly, it may be desirable to achieve an improved design that is not so restricted in terms of its width.

BRIEF SUMMARY OF SOME EXAMPLES

Some example embodiments may provide an oven that employs a choke system that is capable of inhibiting or preventing RF leakage without the typical width restrictions that are well known in the art. In particular, some example embodiments may provide a choke assembly that employs a multi-width structure that is resonant, but is smaller than traditional chokes.

In an example embodiment, an oven is provided. The oven may include a radio frequency (RF) source, a cooking chamber into which RF energy is providable via the RF source, a door and a choke assembly. The door may be configured to hingedly operate to alternately allow access to the cooking chamber and close the cooking chamber for cooking. The choke assembly may be disposed to seal a region between the door and walls that form the cooking chamber from RF leakage responsive to closure of the door. The choke assembly may include a capacitive coupling element and an inductive tuning element. The capacitive coupling element may include a plurality of tabs each having a first width. The inductive tuning element may include a plurality of projections bent relative to the capacitive coupling elements at a right angle, the projections each having a second width that is smaller than the first width.

In another alternative embodiment, a choke assembly is provided. The choke assembly may be for provision onto an oven door to seal radio frequency (RF) energy within the oven when the door is closed. The choke assembly may include a capacitive coupling element and an inductive tuning element. The capacitive coupling element may include a plurality of tabs each having a first width. The inductive tuning element may include a plurality of projections bent relative to the capacitive coupling elements at a right angle, the projections each having a second width that is smaller than the first width.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
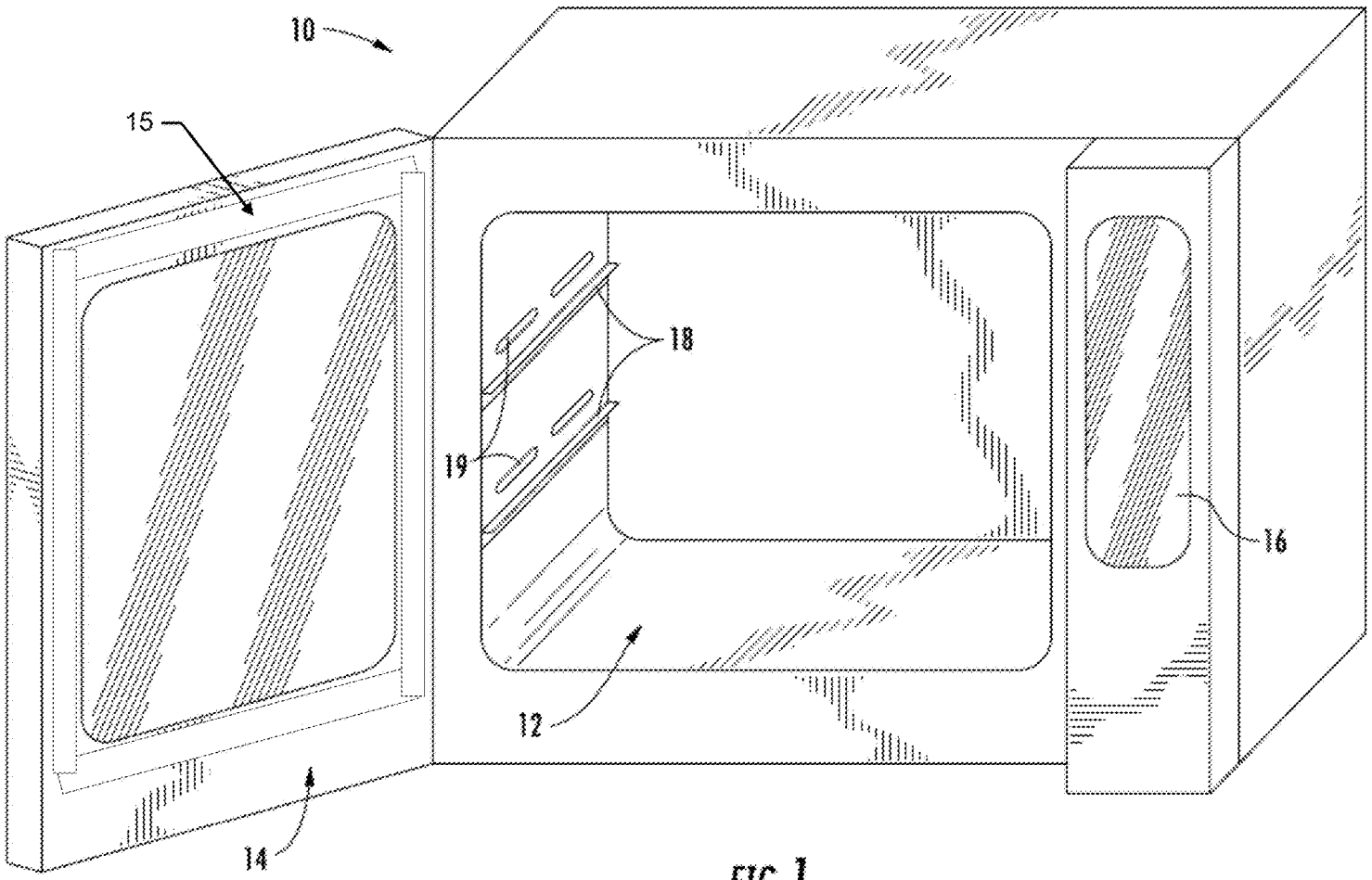
FIG. 1 illustrates a perspective view of an oven employing at least an RF energy source according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve the performance of an oven employing an example embodiment relative to inhibition or prevention of RF leakage. In this regard, since some example embodiments may implement RF cooking, a conventional RF choke would normally be positioned around the door of the oven to prevent RF leakage. However, such chokes are typically tuned based on quarter wave resonance, and therefore have rigid width requirements. If it is desirable to have a sleeker form factor for the oven, a door having a relatively large width may be cumbersome and otherwise undesirable. Example embodiments may therefore incorporate a multiple-width structure in a choke system that can effectively contain frequencies relative to a conventional RF choke, but do so with a smaller width.

FIG. 1 illustrates a perspective view of an oven 10 according to an example embodiment. The oven 10 may be a heating device of any type for heating food products, thawing frozen materials and/or the like. Thus, the oven need not necessarily be embodied only as a combination oven or a microwave oven, but could alternatively be a thawing, warming, sterilizing or other device that applies RF energy. As shown in FIG. 1, the oven 10 may include a cooking chamber 12 into which a food product may be placed for the application of heat. In some cases, the oven 10 may apply heat using any of at least two energy sources that may be employed by the oven 10. However, it should be appreciated that example embodiments may also be practiced with ovens that only employ a single heat application source. Thus, the example described herein is only one non-limiting example.

The cooking chamber 12 may include a door 14 and an interface panel 16, which may sit proximate to the door 14 when the door 14 is closed. In an example embodiment, the user interface panel 16 may include a touch screen display capable of providing visual indications to an operator and further capable of receiving touch inputs from the operator. The user interface panel 16 may be the mechanism by which instructions are provided to the operator, and the mechanism by which feedback is provided to the operator regarding cooking process status, options and/or the like. In other examples, the user interface panel 16 may include a simple interface of buttons, lights, dials and/or the like.

In an example embodiment, the door 14 may be provided with a choke assembly 15 to prevent leakage of RF energy generated within the cooking chamber 12 to areas external to the oven 10. The choke assembly 15, which only conceptually shown in FIG. 1, may extend around a window portion of the door 12 to coincide with sidewalls and the top and bottom walls defining the cooking chamber 12. Thus, when the door 14 is closed, the walls of the cooking chamber 12, the window portion of the door 12 (if employed), and the choke assembly 15 may combine to contain RF energy and inhibit or prevent RF leakage. The choke assembly 15 will be described in greater detail below.

In some embodiments, the oven 10 may include multiple racks or may include rack (or pan) supports 18 or guide slots in order to facilitate the insertion of one or more racks or pans holding food product that is to be cooked. In an example embodiment, airflow slots 19 may be positioned proximate to the rack supports 18 (e.g., above the rack supports in one embodiment) to enable air to be forced over a surface of food product placed in a pan or rack associated with the corresponding rack supports 18. Food product placed on any one of the racks (or simply on a base of the cooking chamber 12 in embodiments where multiple racks are not employed) may be heated at least partially using radio frequency (RF) energy. Meanwhile, the airflow that may be provided may be heated to enable browning to be accomplished.

Figure 2:
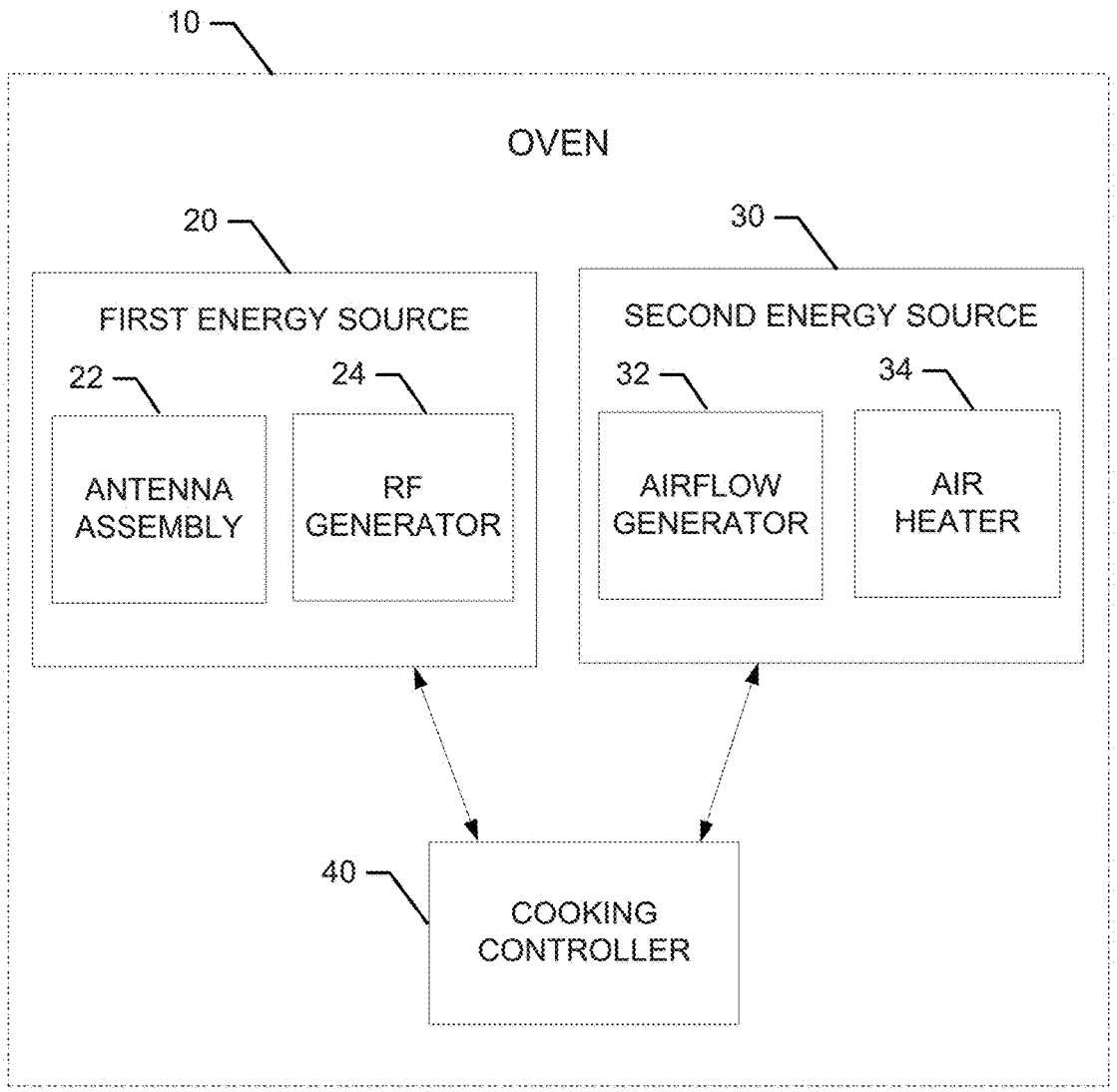
FIG. 2 illustrates a functional block diagram of the oven of FIG. 1 according to an example embodiment.

FIG. 2 illustrates a functional block diagram of the oven 10 according to an example embodiment. As shown in FIG. 2, the oven 10 may include at least a first energy source 20 and a second energy source 30. The first and second energy sources 20 and 30 may each correspond to respective different cooking methods. However, it should be appreciated that additional energy sources may also be provided in some embodiments and, as stated above, some embodiments may only employ a single energy source.

In an example embodiment, the first energy source 20 may be an RF energy source configured to generate RF energy to cook food product placed in the cooking chamber 12 of the oven 10. Thus, for example, the first energy source 20 may include an antenna assembly 22 and an RF generator 24. The RF generator 24 of one example embodiment may be configured to generate RF energy at selected levels over a range of about 800 MHz to about 1 GHz. However, in some cases, the RF generator 24 may be configured to generate RF energy at about 915 MHz. Other frequencies in the RF and microwave spectrum are also possible. In some cases, the antenna assembly 22 may be configured to transmit the RF energy into the cooking chamber 12 and receive feedback to indicate absorption levels of respective different frequencies in the food product. The absorption levels may then be used, at least in part, to control the generation of RF energy to provide balanced cooking of the food product.

In some example embodiments, the second energy source 30 may be an energy source capable of inducing browning of the food product. Thus, for example, the second energy source 30 may include an airflow generator 32 and an air heater 34. However, in some cases, the second energy source 30 may be an infrared energy source, or some other energy source. In examples where the second energy source 30 includes the airflow generator 32, the airflow generator 32 may include a fan or other device capable of driving airflow through the cooking chamber 12 and over a surface of the food product (e.g., via the airflow slots). The air heater 34 may be an electrical heating element or other type of heater that heats air to be driven over the surface of the food product by the airflow generator 32. Both the temperature of the air and the speed of airflow will impact browning times that are achieved using the second energy source 30.

In an example embodiment, the first and second energy sources 20 and 30 may be controlled, either directly or indirectly, by a cooking controller 40. Moreover, it should be appreciated that either or both of the first and second energy sources 20 and 30 may be operated responsive to settings or control inputs that may be provided at the beginning, during or at the end of a program cooking cycle. Furthermore, energy delivered via either or both of the first and second energy sources 20 and 30 may be displayable via operation of the cooking controller 40. The cooking controller 40 may be configured to receive inputs descriptive of the food product and/or cooking conditions in order to provide instructions or controls to the first and second energy sources 20 and 30 to control the cooking process. The first energy source 20 may be said to provide primary heating of the food product, while the second energy source 30 provides secondary heating of the food product. However, it should be appreciated that the terms primary and secondary in this context do not necessarily provide any indication of the relative amounts of energy added by each source. Thus, for example, the secondary heating provided by the second energy source 30 may represent a larger total amount of energy than the primary heating provided by the first energy source 20. Thus, the term "primary" may indicate a temporal relationship and/or may be indicative of the fact that the first energy source is an energy source that can be directly measured, monitored and displayed. In some embodiments, the cooking controller 40 may be configured to receive both static and dynamic inputs regarding the food product and/or cooking conditions. Dynamic inputs may include feedback data regarding absorption of RF spectrum, as described above. In some cases, dynamic inputs may include adjustments made by the operator during the cooking process (e.g., to control the first energy source 20 or the second energy source 30), or changing (or changeable) cooking parameters that may be measured via a sensor network. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), and/or the like.

Figure 3:
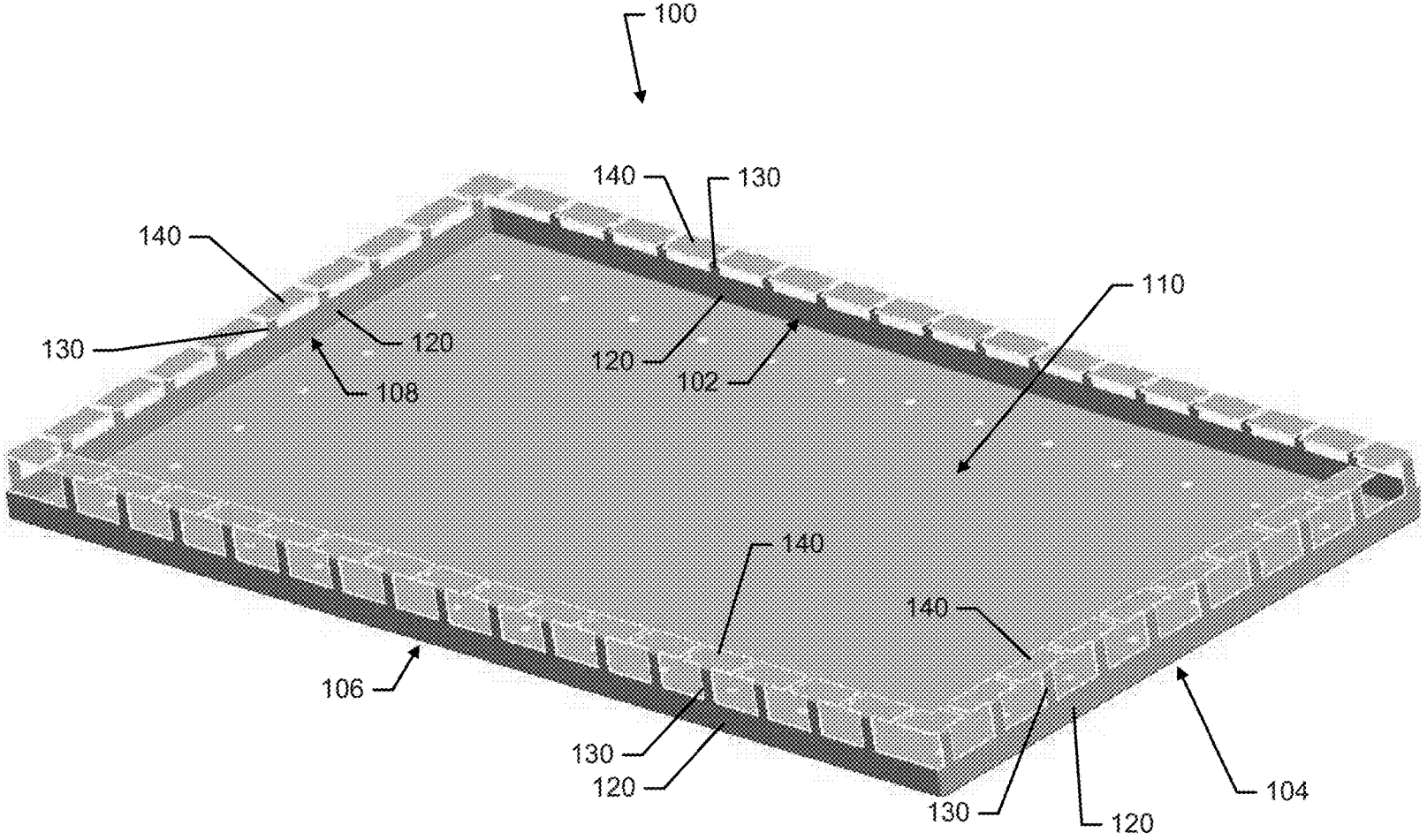
FIG. 3 illustrates a perspective view of a choke assembly in accordance with an example embodiment.
Figure 4:
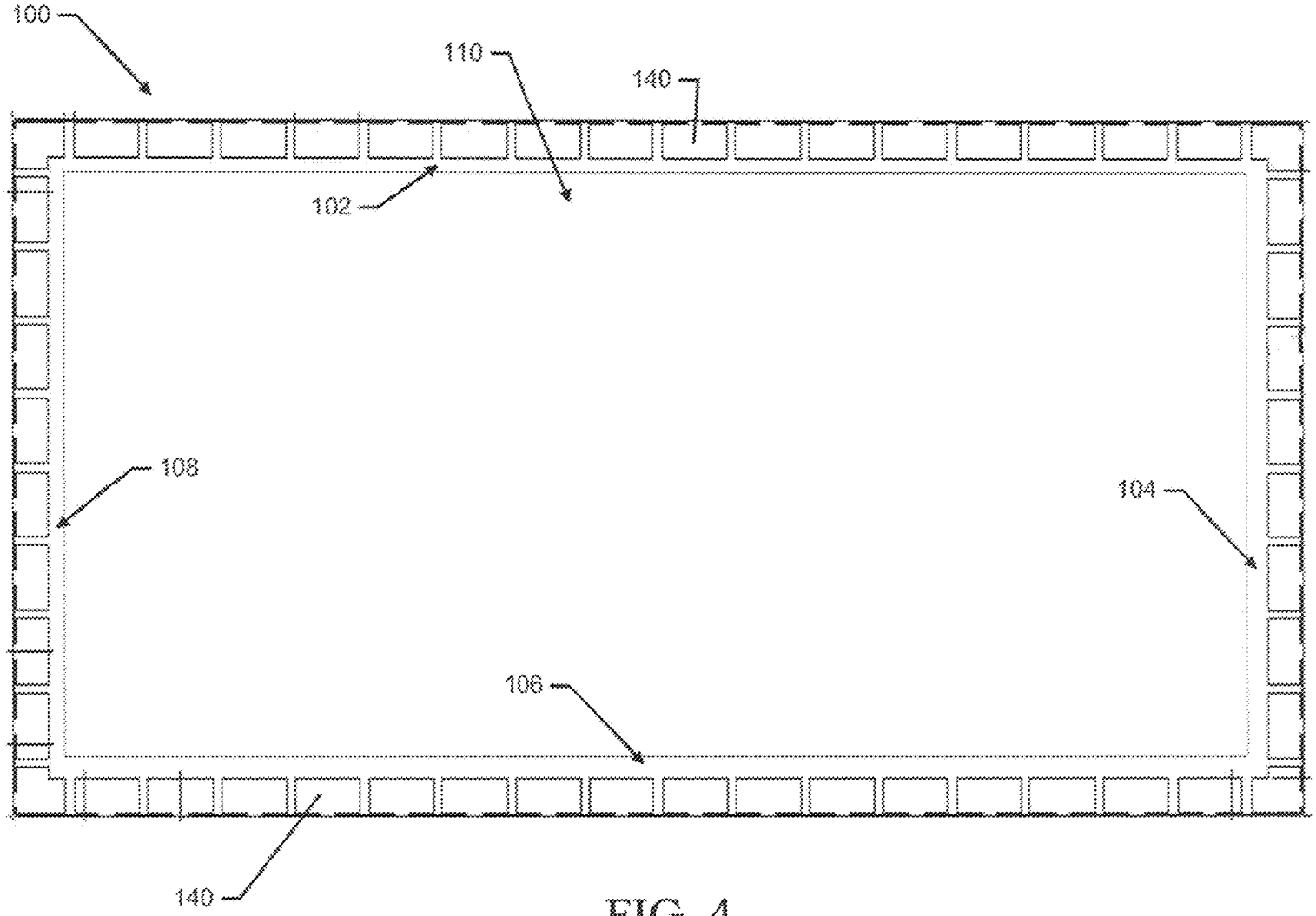
FIG. 4 illustrates a top view of the choke assembly in accordance with an example embodiment.
Figure 5:
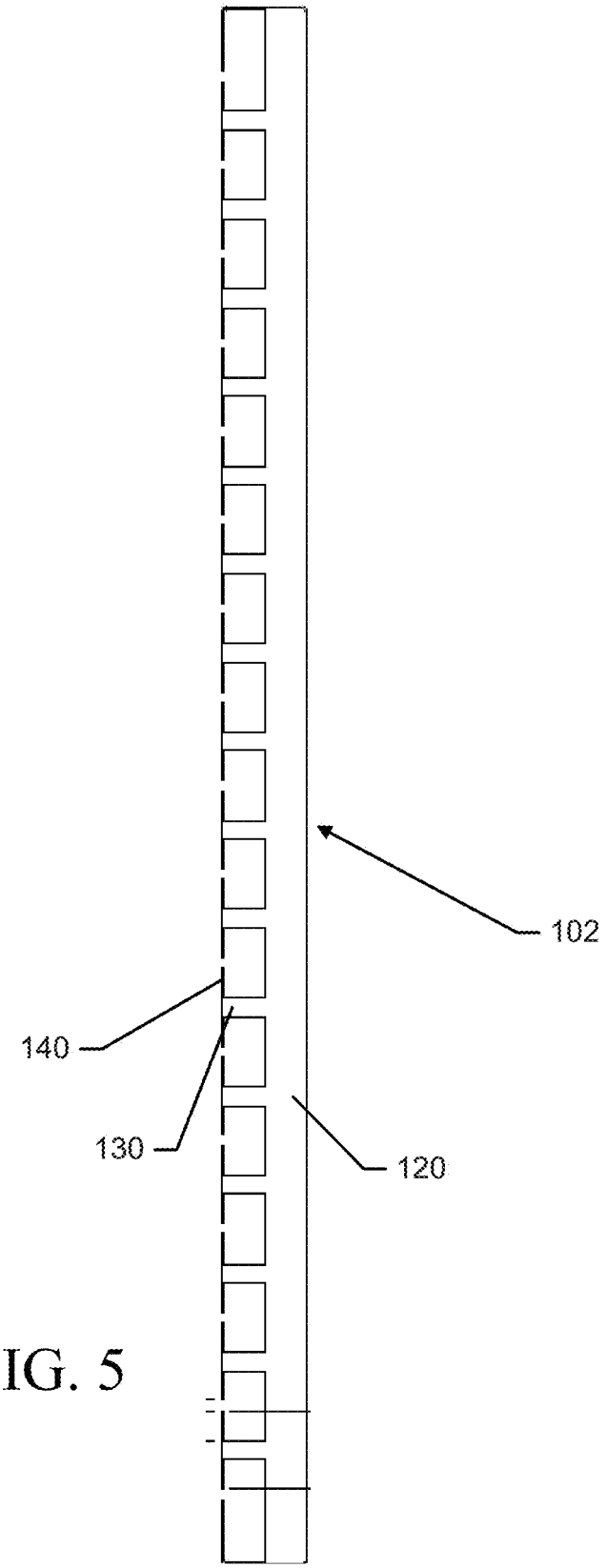
FIG. 5 illustrates a side view of the choke assembly from a perspective from which one of the longer sides of the choke assembly is visible in accordance with an example embodiment.
Figure 6:
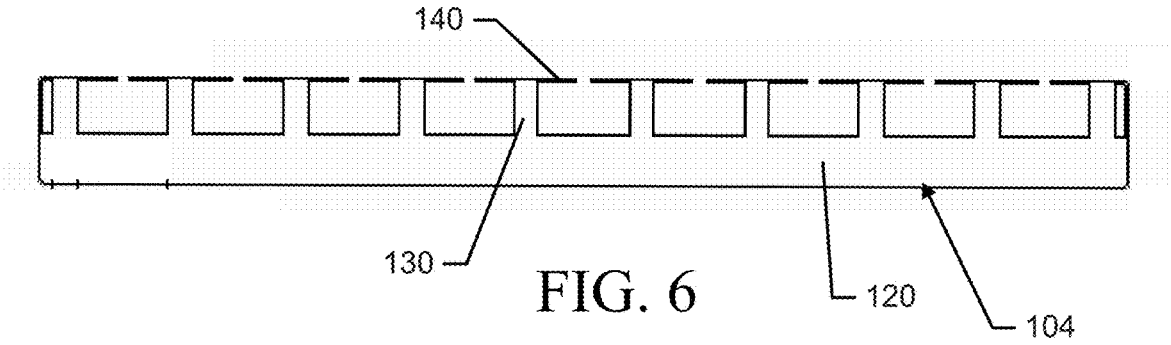
FIG. 6 illustrates a side view of the choke assembly from a perspective from which one of the shorter sides of the choke assembly is visible according to an example embodiment.
Figure 7:
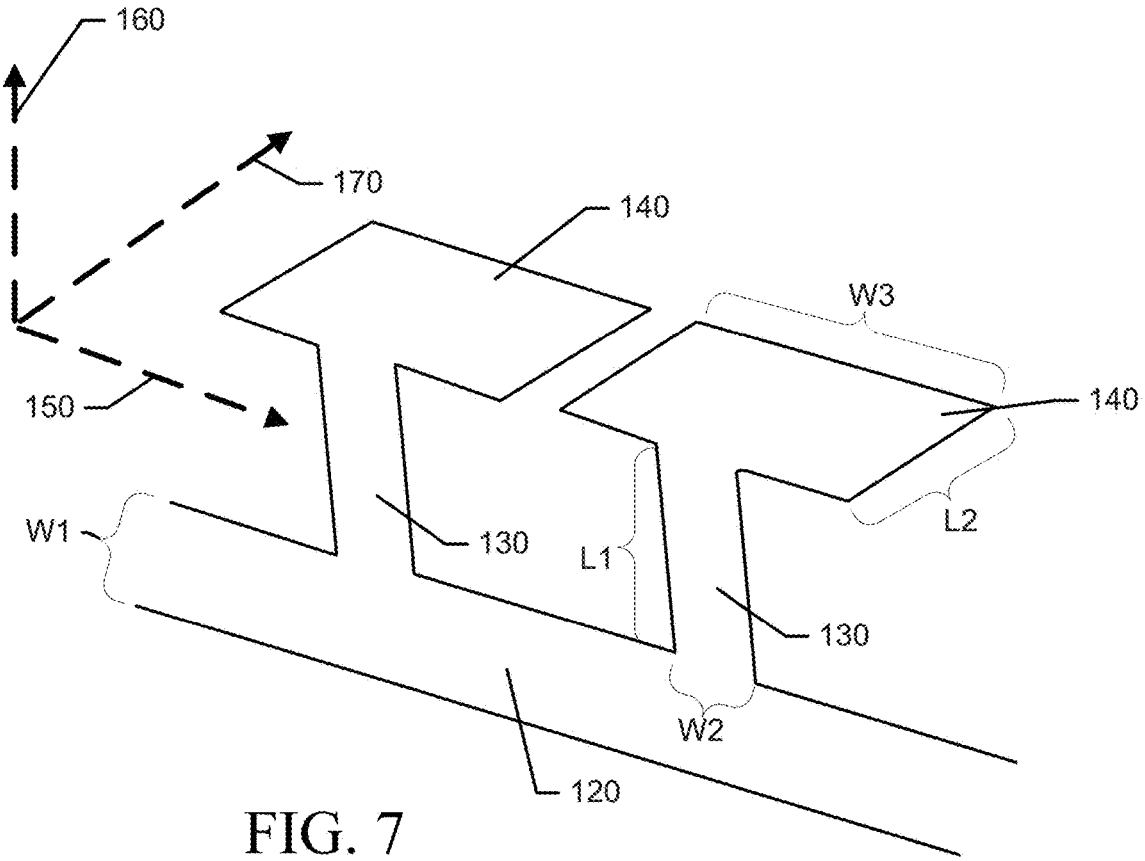
FIG. 7 is a perspective view of a portion of the choke assembly in accordance with an example embodiment.

In some embodiments, a choke configuration may be employed for the oven 10 of FIGS. 1 and 2 to attenuate RF in an applicable frequency range. FIGS. 3-7 illustrate examples of a multi-width structure for a choke assembly 100 that may be provided as an example of the choke assembly 15 represented generically in FIG. 1. In this regard, FIG. 3 illustrates a perspective view of the choke assembly 100 in accordance with an example embodiment. FIG. 4 illustrates a top view of the choke assembly 100 in accordance with an example embodiment. FIG. 5 illustrates a side view of the choke assembly 100 from a perspective from which one of the longer sides of the choke assembly 100 is visible, and FIG. 6 illustrates a side view of the choke assembly 100 from a perspective from which one of the shorter sides of the choke assembly 100 is visible. FIG. 7 is a perspective view of a portion of the choke assembly in accordance with an example embodiment.

Referring to FIGS. 3-7, the choke assembly 100 may be formed from choke stock that is cut and/or bent to have the structure described herein. In this regard, in some examples, the choke stock may be formed or extruded in any length and with any desirable tuning characteristics. The choke stock may then be cut and arranged to be disposed around a window portion of the door 14 to form the choke assembly 15 of FIG. 1. For example, the choke assembly 100 may be formed by arranging four cut pieces of the choke stock (one piece defining each side) to define a window opening for the window portion of the door 14. In such an example, each of the choke stock pieces may be arranged to surround outer edges of the window opening. The choke assembly 100 may be formed by welding together each of the pieces of the choke stock. Thus, after cutting and arranging the choke stock, a plurality of precise welds may be formed between each discrete piece of choke stock that forms the choke assembly 100. Alternatively, the choke assembly 100 may be formed by bending a continuous piece of choke stock around the outer edges of the window opening in order to minimize or reduce the number of welds (e.g., to as few as one). Prior to such bending, the structures that form the choke assembly 100 may also be cut and/or bent into position. In cases where no window is employed, the window portion of the door may be replaced with other shielding.

As shown in FIGS. 3-7, the choke assembly 100 may have four sides including a first side 102, a second side 104, a third side 106 and a fourth side 108. Each of the four sides may be connected at its ends to an adjacent and perpendicularly extending side to define a window opening 110 in or proximate to which the window of the door 14 may be provided. The four sides may therefore all lie in a first plane substantially parallel to a plane in which the window of the door 14 lies. In an example embodiment, each of the four sides of the choke assembly 100 may further include three distinct portions including a low impedance resonator and grounding element 120, an inductive tuning element 130, and a capacitive coupling element 140. The low impedance resonator and grounding element 120 and the inductive tuning element 130 are each formed substantially perpendicular to the first plane. Furthermore, the low impedance resonator and grounding element 120 and the inductive tuning element 130 are disposed to form the outer periphery of the choke assembly 100. Meanwhile, the capacitive coupling element 140 is formed to extend substantially perpendicular to the direction of extension of the inductive tuning element 130.

The structure of the choke assembly 100 is described in greater detail in specific reference to FIG. 7, which shows a closer view of the portions that combine to form each of the four sides of the choke assembly 100. As shown in FIG. 7, the low impedance resonator and grounding element 120 extends longitudinally in a first direction 150 that is parallel to the direction of extension of the corresponding side on which this respective portion of the low impedance resonator and grounding element 120 is formed. The low impedance resonator and grounding element 120 may be formed as an elongated, relatively thin metallic strip having a continuous width (W1) in a transverse direction that is substantially parallel to a second direction 160. The first and second directions 150 and 160 are substantially perpendicular to each other. In some cases, the thin metallic strip may be formed from a 20 gauge (0.0375 inch) stainless steel sheet.

The inductive tuning element 130 may be formed as a plurality of finger-like projections that are spaced apart from each other and extend away from the low impedance resonator and grounding element 120 in the second direction 160. Each finger-like projection of the inductive tuning element 130 may also be formed as an elongated, relatively thin metallic strip having a same thickness as the thickness of the low impedance resonator and grounding element 120. Moreover, the inductive tuning element 130 and the low impedance resonator and grounding element 120 may each lie in a common plane extending in the second direction. Each finger-like projection of the inductive tuning element 130 may extend longitudinally between the low impedance resonator and grounding element 120 and the capacitive coupling element 140 with a length (L1). Each finger-like projection of the inductive tuning element 130 may also have a continuous width (W2) in a transverse direction that is substantially parallel to the first direction 150.

The capacitive coupling element 140 is formed as a plurality of tabs that are attached to the end of the inductive tuning element 130 that is opposite the end of the inductive tuning element 130 that contacts the low impedance resonator and grounding element 120. The capacitive coupling element 140 is bent at substantially a right angle relative to the inductive tuning element 130. Accordingly, the capacitive coupling element 140 extends in a third direction 170 that is substantially perpendicular to the second direction 160 (and the first direction 150). Each tab forming the capacitive coupling element 140 has a width (W3) arranged to extend parallel to the first direction 150 and a length (L2) arranged to extend in the third direction 170. Of note, unlike the other elements, the length (L2) of the capacitive coupling element 140 is actually smaller than the width (W3). Also, as can be appreciated from FIG. 7, (W3) is greater than (W2). In some embodiments, a ratio of (W2) to (W3) may be in a range between about ⅛ and about ⅐. Another feature of the choke assembly 100 that is not necessarily readily appreciable from FIG. 7 is that the lengths (L1) and (L2) are not selected for quarter wave resonance. Instead, the lengths (L1) and (L2) are actually shorter than those that would be selected for quarter wave resonance.

Of note, in a typical choke assembly, the widths (W2) and (W3) are equal, and the lengths (L1) and (L2) are selected to achieve quarter wave resonance. However, the structure of the choke assembly 100 represents a variation of a semi-lumped design normally found on planar circuits such as micro-strip and stripline geometries. A difference between the choke assembly 100 and printed filters having the geometries discussed above is that the capacitive coupling element 140 is a low impedance coupling element to the RF leakage signals, and that the multi-width structure provides resonance in a smaller package than the traditional design approach. This is because the lengths (L1) and (L2) of the choke assembly 100 combine to have less than the typical quarter wave resonance design's combined length. The inductive and capacitive elements of the choke assembly 100 form a resonant short circuit with low impedance to ground. The choke assembly 100 is therefore an effective reflector to keep RF leakage signals within the oven cavity, while having a smaller profile than the typical quarter wave resonance designs.

The narrow width (W2) of the inductive tuning element 130 tunes the combined impedance of the capacitive coupling element 140 and the inductive tuning element 130 such that it will resonate with the low impedance resonator and grounding element 120. The overall effect is to present a narrow band stop filter effect to any RF leakage signal attempting to leak around the edge of the oven cavity/door interface. The RF leakage signal will instead be reflected back into the oven cavity.

In an example embodiment designed for leakage prevention at around 915 MHz, (L1) may be about 19 mm and (W1) may be about 16.9 mm. (W2) may be about 4.5 mm and (W3) may be about 33 mm. (L2) may be about 18.9 mm. The gap between edges of the fingers forming the inductive tuning element 130 may be about 29.5 mm, and the gap between edges of the tabs forming the capacitive coupling element 140 may be about 4.5 mm. An overall length of the choke assembly 100 (e.g., (W1)+(L1)+(L2)) may therefore be about 55 mm. Given that a conventional choke with quarter wave resonance would typically be about 80 mm in combined length, example embodiments represent an overall length reduction of greater than 20% for a given frequency.

Figure 8:
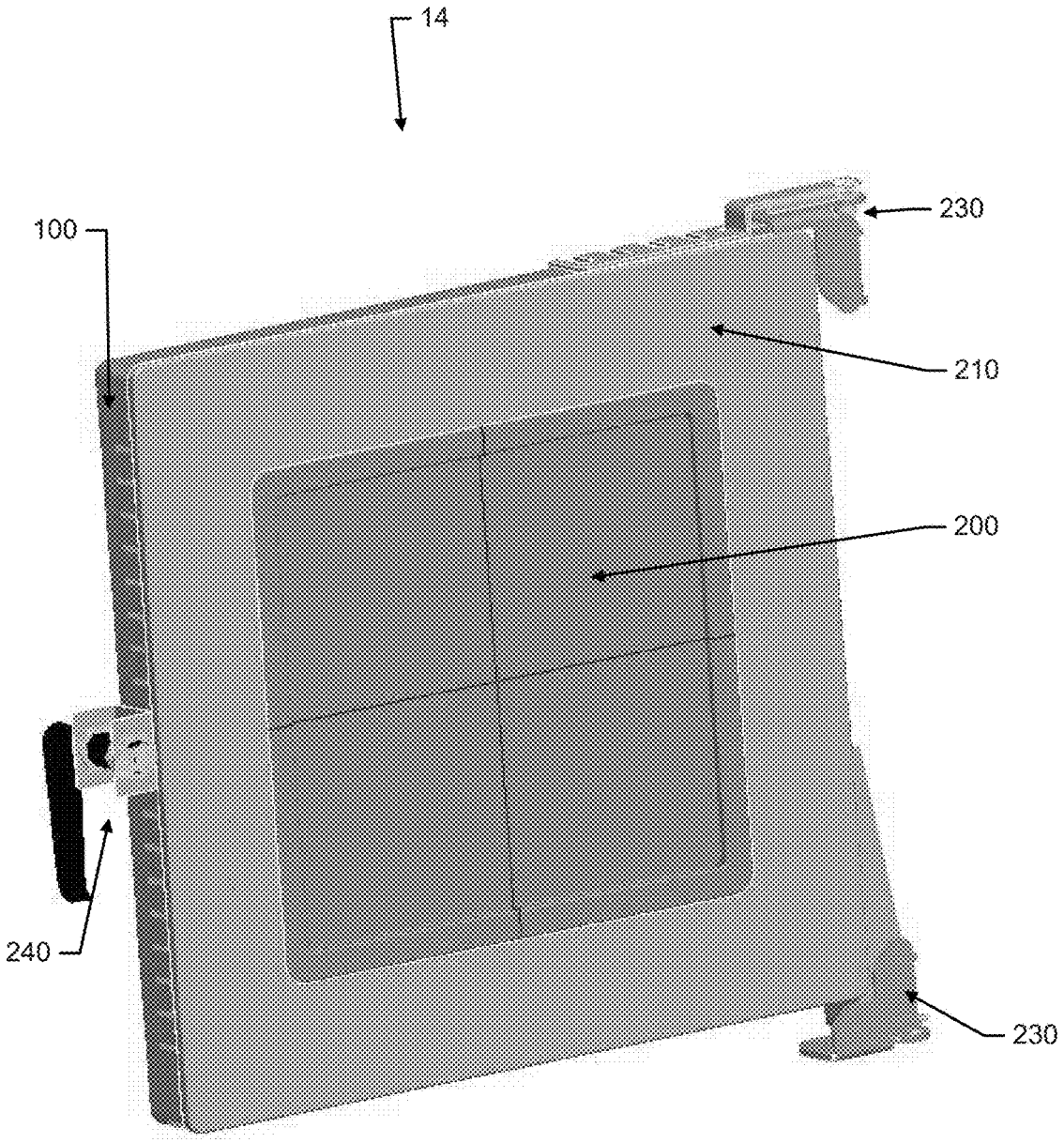
FIG. 8 illustrates a perspective view of a door incorporating the choke assembly according to an example embodiment.

FIG. 8 illustrates a perspective view of a door according to an example embodiment. As can be seen in FIG. 8, the door 14 includes a window portion 200 surrounded by a cover 210. The choke assembly 100 is then shown on a back portion of the door 14. The window portion 200 may include glass, RF screens, combinations thereof, or other screening mechanisms. The choke assembly 100 may also be covered by a back cover (removed). The door 14 may be mounted on a hinge assembly 230 and may include a latch assembly 240 to enable opening and closing of the door in addition to latching of the door when the door is closed.

Example embodiments may provide a choke system capable of providing effective RF leakage prevention in a smaller form factor than conventional choke systems. The door of the oven may therefore be thinner. Some example embodiments may provide this choke system through a structure including a multi-width capacitive coupling element and inductive tuning element combination, where widths of each respective element are different.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

a radio frequency (RF) source;

a cooking chamber into which RF energy is providable via the RF source;

a door configured to hingedly operate to alternately allow access to the cooking chamber and close the cooking chamber for cooking; and a choke assembly disposed to seal a region between the door and walls of the oven that define the cooking chamber from RF leakage responsive to closure of the door, wherein the choke assembly comprises:

a capacitive coupling element comprising a plurality of tabs each having a first width;

an inductive tuning element comprising a plurality of projections bent relative to the capacitive coupling elements at a right angle, the projections each having a second width that is smaller than the first width; and a low impedance resonator and grounding element, wherein the low impedance resonator and grounding element has a width extending in a direction parallel to a length of the inductive tuning element and substantially perpendicular to a length of the capacitive coupling element, wherein a combined length of the choke assembly comprises the width of the low impedance resonator and grounding element, the length of the inductive tuning element and the length of the capacitive coupling element, and wherein the combined length of the choke assembly for a given frequency is about 20% less than a combined length of a quarter wave resonant choke for the given frequency.

2. The oven of claim 1, wherein the inductive tuning element extends between the low impedance resonator and grounding element at a first end of the inductive tuning element and the capacitive coupling element at a second end of the inductive tuning element.

3. The oven of claim 1, wherein the inductive tuning element and the low impedance resonator and grounding element each lie in a same plane.

4. The oven of claim 3, wherein the tabs of the capacitive coupling element are each spaced apart from each other by a distance substantially equal to the second width.

5. The oven of claim 1, wherein a length of the inductive tuning element is greater than a width of the low impedance resonator and grounding element.

6. The oven of claim 1, wherein a ratio of the second width to the first width in a range between about ⅛ and about ⅐.

7. The oven of claim 1, wherein the choke assembly is tuned to reflect RF energy at about 915 MHz.

8. The oven of claim 1, wherein the choke assembly comprises four sides extending around respective edges of the door, each of the four sides including a corresponding set of tabs and projections, and wherein the four sides are formed from a single metallic sheet bent to form the four sides and welded at opposing ends such that there is only one weld joint between any of the four sides of the choke assembly.

9. A choke assembly for provision onto an oven door to seal radio frequency (RF) energy within the oven when the door is closed, the choke assembly comprising:

a capacitive coupling element comprising a plurality of tabs each having a first width;

an inductive tuning element comprising a plurality of projections bent relative to the capacitive coupling elements at a right angle, the projections each having a second width that is smaller than the first width; and a low impedance resonator and grounding element, wherein the low impedance resonator and grounding element has a width extending in a direction parallel to a length of the inductive tuning element and substantially perpendicular to a length of the capacitive coupling element, wherein a combined length of the choke assembly comprises the width of the low impedance resonator and grounding element, the length of the inductive tuning element and the length of the capacitive coupling element, and wherein the combined length of the choke assembly for a given frequency is about 20% less than a combined length of a quarter wave resonant choke for the given frequency.

10. The choke assembly of claim 9, wherein the inductive tuning element extends between the low impedance resonator and grounding element at a first end of the inductive tuning element and the capacitive coupling element at a second end of the inductive tuning element.

11. The choke assembly of claim 9, wherein the inductive tuning element and the low impedance resonator and grounding element each lie in a same plane.

12. The choke assembly of claim 1, wherein the tabs of the capacitive coupling element are each spaced apart from each other by a distance substantially equal to the second width.

13. The choke assembly of claim 9, wherein a length of the inductive tuning element is greater than a width of the low impedance resonator and grounding element.

14. The choke assembly of claim 9, wherein a ratio of the second width to the first width in a range between about ⅛ and about ⅐.

15. The choke assembly of claim 9, wherein the choke assembly is tuned to reflect RF energy at about 915 MHz.

16. The choke assembly of claim 9, wherein the choke assembly comprises four sides extending around respective edges of the door, each of the four sides including a corresponding set of tabs and projections, and wherein the four sides are formed from a single metallic sheet bent to form the four sides and welded at opposing ends such that there is only one weld joint between any of the four sides of the choke assembly.

* * * * *